US005611615A

United States Patent [19]

Jang

[11] Patent Number: 5,611,615

[45] Date of Patent: Mar. 18, 1997

[54] MULTI-PURPOSE MOUNTAIN CLIMBING TOOL

[76] Inventor: Siang-Guey Jang, No. 78, Jen-Sing Road, Da-Li, Taichung, Taiwan

[21] Appl. No.: 643,566

[22] Filed: May 6, 1996

[51] Int. Cl.[6] ..... B25B 23/18

[52] U.S. Cl. ..... 362/119; 362/109; 362/208; 362/253

[58] Field of Search ..... 362/109, 119, 362/120, 157, 202, 208, 253

[56] References Cited

U.S. PATENT DOCUMENTS 5,226,718 7/1993 Lin ..... 362/119
5,313,376 5/1994 McIntosh ..... 362/119

*Primary Examiner*—Stephen F. Husar
*Attorney, Agent, or Firm*—Browdy and Neimark

[57] ABSTRACT

A multipurpose mountain climbing tool comprises a first main member, a second main member and a third main member. The first main member is provided therein with a first receiving cell and a second receiving cell and is further provided peripherally at the midsegment thereof with a compass and a thermometer. The second main member is provided at the midsegment thereof with a protruded ring portion and is further provided at the rear end thereof with a knife fastened thereto. The second main member is fastened at the rear segment thereof with the front end of the first main member such that the knife is received in the second receiving cell. The third main member is fastened with the front side of the second main member and is provided therein with a battery. The third main member is further provided in the front segment thereof with a light bulb.

1 Claim, 4 Drawing Sheets

MULTI-PURPOSE MOUNTAIN CLIMBING TOOL

BACKGROUND OF THE INVENTION

The present invention relates to a tool, and more particularly to a multi-purpose mountain climbing tool.

The mountain climbing calls for a variety of tools, such as knife, flashlight, compass, etc. It is readily apparent that the mountain climbing tools are rather cumbersome to a mountain climber.

SUMMARY OF THE INVENTION

It is therefore an object of the present invention to provide a multi-purpose mountain climbing tool which is intended to reduce the load of a mountain climber.

The present invention may be understood through the following description with reference to the accompanying drawings, in which:

DETAILED DESCRIPTION OF THE EMBODIMENT

Figure 1:
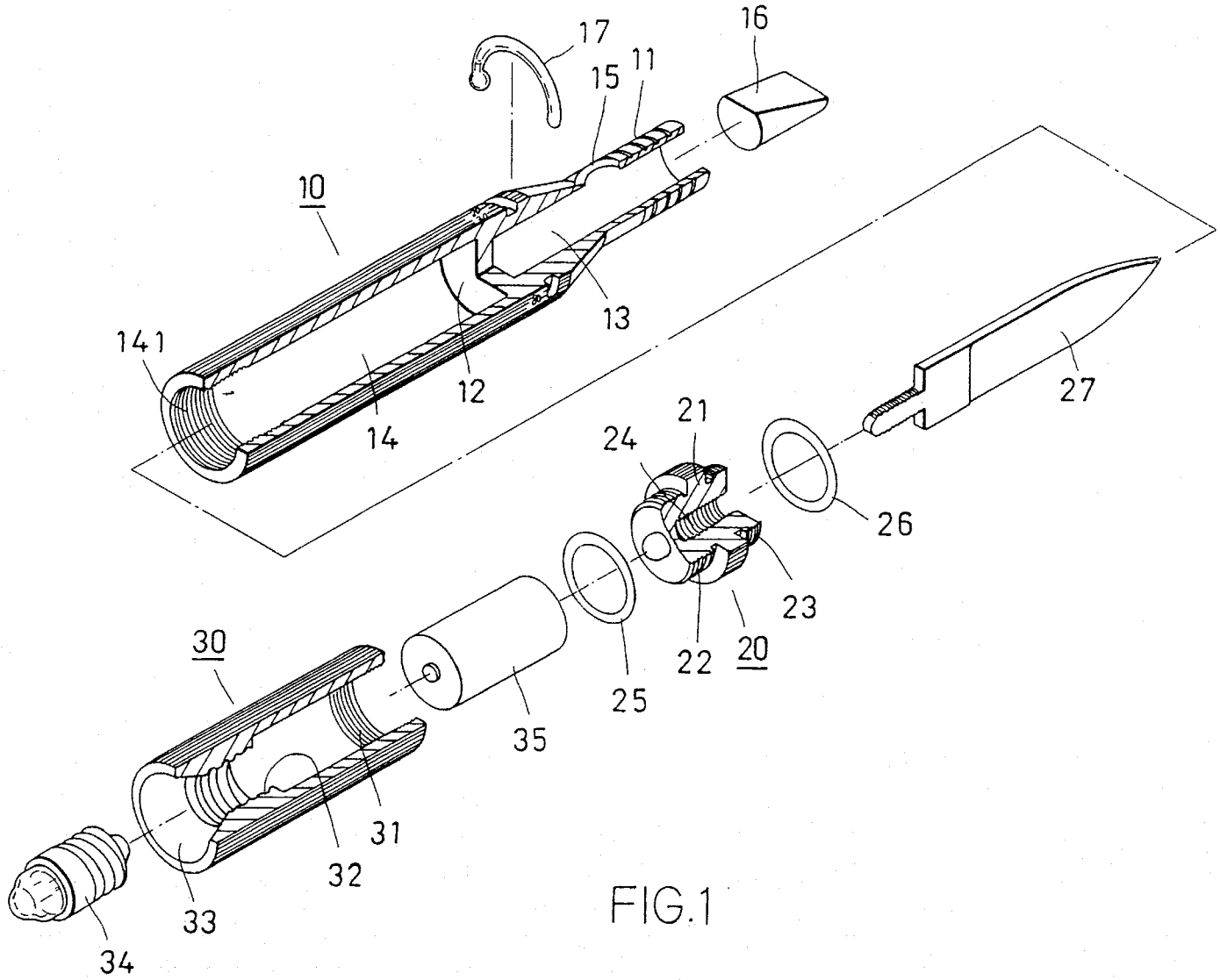
FIG. 1 is an exploded view of the present invention.
Figure 2:
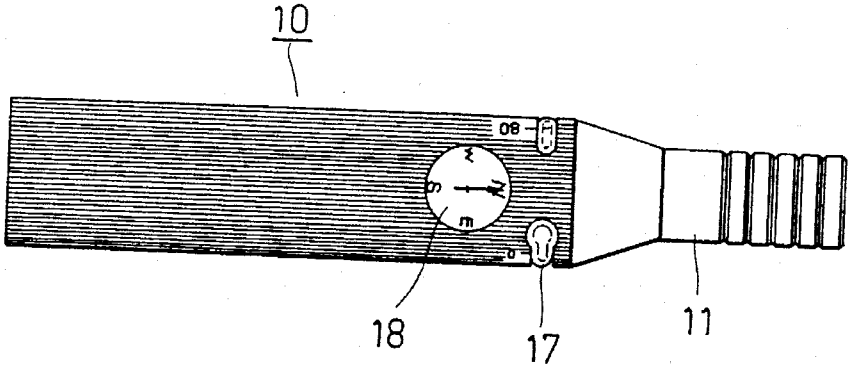
FIG. 2 is a side plan view of the first main member 10 as shown in FIG. 1.
Figure 3:
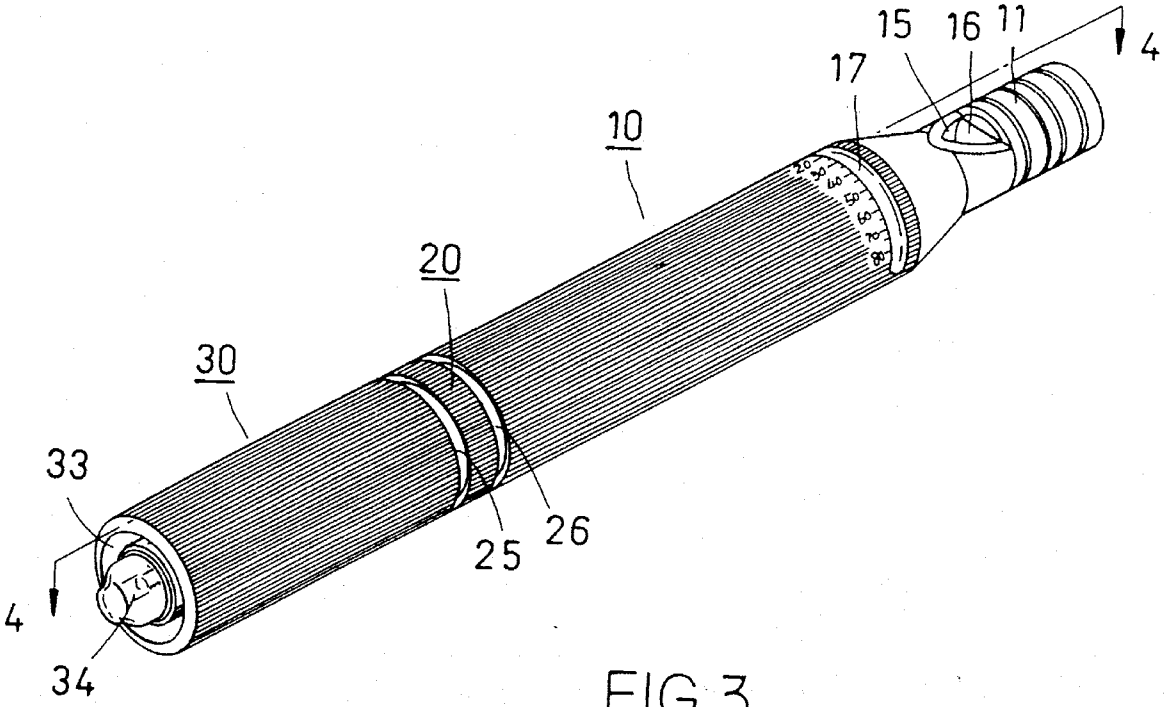
FIG. 3 is a perspective view of the present invention in combination.
Figure 4:
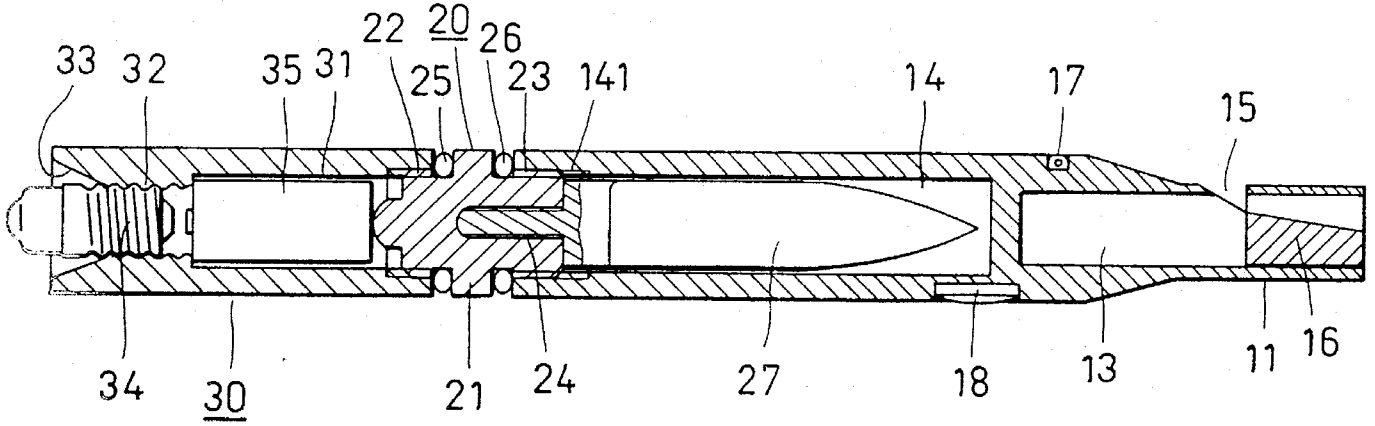
FIG. 4 is a sectional view of the present invention as shown in FIG. 3.

Referring now to FIGS. 1–4, a preferred embodiment according to the present invention includes a first main member 10, a second main member 20 and a third main member 30.

The first main member 10 is provided at a rear end thereof with a small diametric portion 11. The first main member 10 is hollow and provided at the midsegment thereof with a first receiving cell 13 and a second receiving cell 14, which are separated by a partition 12. The small diametric portion 11 is provided at the inner segment thereof with a triangular cut 15. The first receiving cell 13 is provided at the outer end thereof with a whistling piece 16. The second receiving cell 14 is provided at the outer end thereof with a female threaded portion 141. The first main member 10 is provided at the midsegment thereof with a thermometer 17 and a compass 18.

The second main member 20 is provided at the midsegment thereof with a protruded ring portion 21 and is further provided respectively at the front and the rear segments thereof with a first male threaded portion 22 and a second male threaded portion 23. The second main member 20 is still further provided at the rear end thereof with a second female threaded portion 24 of an appropriate depth and extending along the axial direction of the second main member 20. The protruded ring portions 21 is provided at the front and the rear sides thereof with O rings 25 and 26. A knife 27 is fastened therewith by means of the second female threaded portion 24. The first female threaded portion 141 of the first main member 10 is engaged with the second male threaded portion 23 of the second main member 20. The knife 27 is received in the second receiving cell 14 of the first main member 10.

The third main member 30 is provided therein with a third female threaded portion 31 extending from the rear end thereof along the direction of the axis thereof. The third main member 30 is further provided with a fourth female threaded portion 32 and a speaker mouth 33 in which a light bulb 34 is received. The third main member 30 is provided at the rear segment of the interior thereof with a battery 35. The first female threaded portion 31 is engaged with the first male threaded portion 22 of the second main member 20 such that the battery 35 is kept apart from the light bulb 34 by an appropriate distance.

Figure 5:
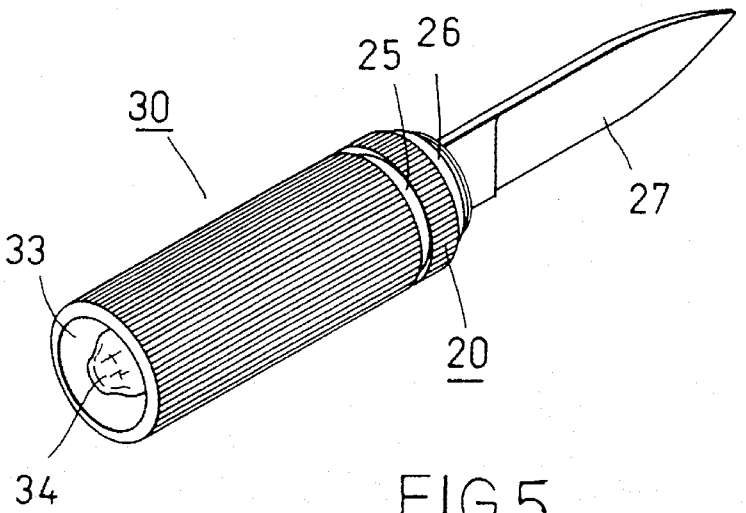
FIG. 5 is a schematic view of the present invention used as a knife after the main member 10 of FIG. 3 is rotated to become detached.

As shown in FIG. 5, the knife 27 of the present invention is available for use after the first main member 10 is detached.

The present invention may be used as a flashlihgt by fastening further the light bulb 34 with hand until the rear end of the light bulb 34 is in contact with the front end of the battery 35, thereby causing the light bulb 34 to illuminate. The light bulb 34 is caused to stop illuminating as soon as the light bulb 34 is unfastened.

Figure 6:
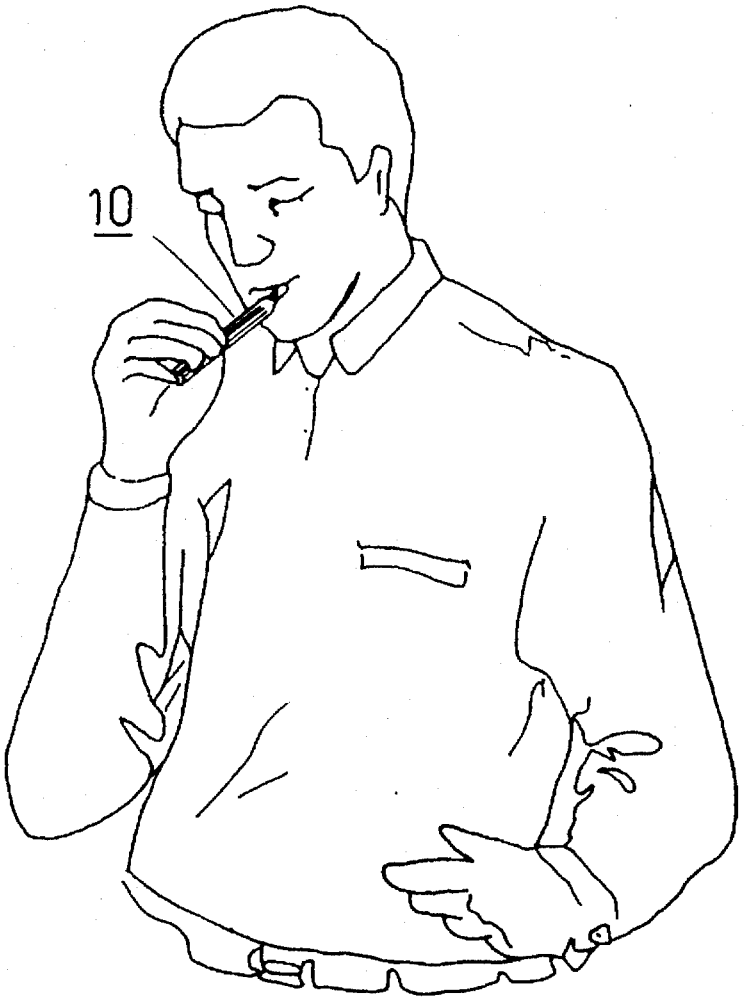
FIG. 6 is a schematic view of the present invention used as a whistle.

As illustrated in FIG. 6, the present invention may be used as a whistle by keeping the outer segment of the small diametric portion 11 of the first main member 10 in the mouth of a person. As the person blows the first main member 10, a clear and shrill sound is made.

The multi-purpose mountain climbing tool of the present invention described above can be used for a variety of purposes, such as a tool for self-defense, cutting articles, illuminating, showing directions and measuring temperature. In addition, the mountain climbing tool of the present invention can be carried around handily.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A multipurpose mountain climbing tool comprising:

a first main member of a metal material and provided at one end thereof with a small diametric portion of a hollow construction, said first main member further provided at a midsegment thereof with a first receiving cell, a second receiving cell and a partition separating said first receiving cell from said second receiving cell, said small diametric portion provided therein with a triangular cut, said first receiving cell provided at one end thereof with a whistling piece, said second receiving cell provided at one end thereof with a first female threaded portion, said first main member further provided at said midsegment therof with a thermometer and a compass;

a second main member of a metal material and provided at a midsegment thereof with a protruded ring portion, said second main member further provided respectively at a front segment thereof and at a rear segment thereof with a first male threaded portion and a second male threaded portion engageable with said first female threaded portion of said first main member, said second main member furthers provided at one end thereof with a second female threaded portion of an appropriate depth and extending in the direction of an axis of said second main member, said protruded ring portion provided respectively at a front side thereof and a rear side thereof with an O ring, said second female threaded portion intended for use in fastening a knife in said second receiving cell of said first main member; and a third main member of a metal material and provided therein with a third female threaded portion, a fourth female threaded portion and a mouth in which a light bulb is received, said third main member further provided in a rear segment thereof with a battery.

* * * * *